US006026953A

United States Patent [19]

Nakamura et al.

[11] Patent Number: 6,026,953

[45] Date of Patent: Feb. 22, 2000

[54] RESEALABLE DISPENSER-CONTAINER

[76] Inventors: Kenji Nakamura; Koji Nakamura, both of 3-41 Nishiawaji 6-chome, Higashiyodogawa-ku, Osaka, Japan

[21] Appl. No.: 09/335,359

[22] Filed: Jun. 17, 1999

[30] Foreign Application Priority Data

Dec. 10, 1998 [JP] Japan ..... 10-009802
Feb. 26, 1999 [JP] Japan ..... 11-051430

[51] Int. Cl.[7] ..... B65D 85/16

[52] U.S. Cl. ..... 206/233; 206/494; 206/812; 53/412; 53/462

[58] Field of Search ..... 53/410, 412, 416, 53/420, 443, 461, 462; 206/233, 494, 812; 220/260, 263, 265, 266

[56] References Cited

U.S. PATENT DOCUMENTS 5,048,718 9/1991 Nakamura ..... 206/233 X
5,531,325 7/1996 Deflander et al. ..... 206/494

FOREIGN PATENT DOCUMENTS 59-2696 7/1981 Japan .
2530521 4/1992 Japan .

*Primary Examiner*—Jacob K. Ackun
*Attorney, Agent, or Firm*—Morgan & Finnegan, L.L.P.

[57] ABSTRACT

A resealable dispenser-container for containing wet tissues. A container, made of a flexible and impervious sheet, has at a top surface an opening for dispensing the wet tissues. A reinforcing sheet, larger than the dispensing opening and of a material harder than that forming the container, is attached to the top surface of the container and has an open looped cut line locating outside of the dispensing opening. The inside region of the open looped cut line is removable from the front end, opposite to the open portion of the open looped cut, toward the open portion so as to form a resealable flap. The reinforcing sheet has a crease locating at the open portion of the open looped cut and extending across the open portion so as to facilitate opening and closing of the flap.

9 Claims, 4 Drawing Sheets

RESEALABLE DISPENSER-CONTAINER

BACKGROUND OF INVENTION

1. Field of the Invention

The present invention relates to a resealable dispenser-container provided with a sheet flap and a process for manufacturing the same.

More specifically, the present invention relates to a resealable dispenser-container which contains, for example, home use commercial goods consumed in several times, especially wet tissues, i.e., fibrous materials, such as non-woven fabric, gauze, or cotton, impregnated with toilet water or cleaning solution including alcohol or the like which tissues are widely used for cleaning make-up, cleaning skin or wiping stains in a kitchen and so on, and a process for manufacturing the same.

2. Description of Related Art

Many containers have been proposed for containing the above-described wet tissues. Containers used for such use are required to prevent wet tissues contained therein from being dried up and to be ensured to easily dispense the wet tissues therefrom.

As a typical dispenser-container for such use, for example, a dispenser-container disclosed in Japanese Utility Model Publication No. Sho 59-2696 has been known. The dispenser-container comprises a container body made of a flexible and impervious sheet of such as synthetic resin and a flap made of a flexible sheet material such as synthetic resin. The container body has at a top surface thereof an opening for dispensing the wet tissues therethrough. The flap is resealably attached to the top of the container body so that it resealably covers the opening.

The dispenser-container disclosed in Japanese Utility Model Publication No. Sho 59-2696 has the following problems. When a number of tissues are contained in the dispenser-container, as the tissues in the container are dispensed and accordingly, as the height of the sheet material lowers, the top surface of the container body which is made of flexible sheet may be deformed or may be waved. Thus, many small clearances may be formed between the lower surface of the flap and the top surface of the container body.

As a result, when the flap is tried to be attached to the top surface of the container body again after it has been opened, the flap cannot be sealably attached to the top of the container body.

In order to obviate such problems, Japanese Utility Model No. 2530521 discloses a dispenser-container which comprises a container body made of a relatively flexible synthetic resin and containing a number of folded wet tissues, the container body having at the top surface thereof an opening for dispensing the wet tissues one by one, and a reinforcing member made of relatively hard synthetic resin is provided above the top surface of the container body surrounding the dispensing opening, and further, a resealable flap sealably closing the dispensing opening is attached to the reinforcing member.

PROBLEMS TO BE SOLVED BY THE INVENTION

When the dispenser-container disclosed in Japanese Utility Model No. 2530521 is compared with that disclosed in Japanese Utility Model Publication No. Sho 59-2696, the former requires the reinforcing member in addition to the flap. Accordingly, the former needs manufacture of the reinforcing member and a process for attaching the reinforcing member. Therefore, the former becomes expensive and causes loss of resources.

BRIEF SUMMARY OF THE INVENTION

Objects of the Invention

It is an object of the present invention to provide a dispenser-container provided with a flap, which can obviate the above-described problems inherent in the conventional dispenser-containers.

It is another object of the present invention to provide a dispenser-container provided with a flap, wherein the flap can be securely opened and resealed from the beginning of use of the dispenser-container to the exhaustion of the contents in the dispenser-container although the size of the container decreases as dispensing the contents.

It is a further object of the present invention to provide a dispenser-container provided with a flap, which does not increase the number of parts and which is easy to manufacture.

It is a still further object of the present invention to provide a process for easily manufacturing such dispenser-containers.

MEANS TO SOLVE THE PROBLEMS

According to the present invention defined in claim 1, the above-described objects are achieved by a resealable dispenser-container for containing contents therein comprising a container, which is made of a flexible and impervious sheet and which has at a top surface thereof an opening for dispensing the contents therethrough or a weakened line for forming the dispensing opening, a flap made of a flexible sheet material which covers the dispensing opening or weakened line for forming the dispensing opening and which is repeatedly opened and closed, a reinforcing sheet, which is larger than the dispensing opening or weakened line for forming the dispensing opening, and which is made of a material harder than that forming the container, attached to the top surface of the container, the reinforcing sheet having an open looped cut line locating outside of the dispensing opening or weakened line for forming the dispensing opening, an inside region of the open looped cut line being removable from a front end which is opposite to the open portion of the open looped cut line toward the open portion so as to form the repeatedly opened and closed flap, and the reinforcing sheet having a crease locating at the open portion of the open looped cut line and extending across the open portion so as to facilitate opening and closing of the repeatedly opened and closed flap formed by the inside region of the open looped cut line.

According to the present invention defined in claim 2, the above-described objects are achieved by a resealable dispenser-container for containing contents therein comprising a container, which is made of a flexible and impervious sheet and which has at a top surface thereof an opening for dispensing the contents therethrough or a weakened line for forming the dispensing opening, a flap made of a flexible sheet material which covers the dispensing opening or weakened line for forming the dispensing opening and which is repeatedly opened and closed, a reinforcing sheet, which is larger than the dispensing opening or weakened line for forming the dispensing opening, and which is made of a material harder than that forming the container, attached to the top surface of the container, the reinforcing sheet having an open looped cut line locating outside of the dispensing opening or weakened line for forming the dispensing opening and inside spacing from a peripheral edge of the reinforcing sheet, an inside region of the open looped cut line being removable from a front end which is opposite to an open portion of the open looped cut line toward the open portion so as to form the repeatedly opened and closed flap, and a bulge shaped grip formed at the front end opposite to the open portion of the open looped cut line, the reinforcing sheet having a narrow region including the grip and extending between facing peripheral edges of the reinforcing sheet in a direction perpendicular to a removing direction of the inside region, the narrow region spacing from a peripheral edge neighboring the grip, and the reinforcing sheet having a pressure sensitive adhesive applied to one side thereof except for the narrow region.

The present invention defined in claim 3, is characterized in that in the present invention defined in claim 2, the reinforcing sheet having a crease locating at the open portion of the open looped cut line and extending across the open portion so as to facilitate opening and closing of the repeatedly opened and closed flap formed by the inside region of the open looped cut line.

According to the present invention defined in claim 1, 2 or 3, the reinforcing sheet attached to the container serves to prevent waving of the top surface of the container and at the same time serves as a flap. Accordingly, the reinforcing sheet can be disposed by means of a disposing process similar to that for a conventional flap. Thus, the manufacture of the dispenser-container is easy.

According to the present invention defined in claim 1, 2 or 3, the relatively hard reinforcing sheet is attached to the top surface of the container, and the inside region of the open looped cut line formed on the reinforcing sheet is used as a flap. Accordingly, even when the size of the container decreases as dispensing the contents, the outside region of the reinforcing sheet locating outside of the open looped cut line prevents waving of the top surface of the container. Thus, the flap can be sealably secured to the container.

Further, according to the present invention defined in claim 1 or 3, the reinforcing sheet has the crease locating at the open portion of the open looped cut line and extending across the open portion. Accordingly, when the flap formed in the hard reinforcing sheet is opened along the open looped cut line, the rigidity of the open portion of the flap is weakened by means of the crease. Thus, even when a thick sheet is used for the reinforcing sheet, the flap can be easily kept in an opened condition, and the contents such as wet tissues contained in the container can be dispensed without any trouble. Further. after the contents are dispensed, since the rigidity of the flap is weakened by the crease, the flap can be readily closed.

According to the present invention defined in claim 2, the narrow region, wherein the grip is formed, does not have any adhesive, and accordingly, the grip has no adhesive applied thereon. Thus, the grip can be readily grasped. In addition, since the edge portion between the narrow region and the peripheral edge neighboring the grip has adhesive applied thereon, the edge portion securely adheres to the surface of the container. Accordingly, the reinforcing sheet does not peel off regardless of existence of the narrow region.

Further, according to the present invention defined in claim 2, the narrow region having no adhesive applied thereon extends between the facing peripheral edges. Accordingly, the reinforcing sheet of the present invention can be manufactured by applying a pressure sensitive adhesive on one side of a long sheet except for a narrow region continuing in a longitudinal direction of the sheet or except for narrow regions spacing in a longitudinal direction of the sheet and extending in a lateral direction of the sheet and punching the sheet in such manner that the grip positions within the narrow region, when the reinforcing sheet is manufactured from a long sheet. Upon such punching, since positioning in one direction, i.e., either longitudinal direction or lateral direction, is only required, positioning can be easily and accurately done even if the preciseness of the punching apparatus is not excessively enhanced. Thus, continuous manufacture of dispenser-containers can be done effectively, and as a result, cost of the dispenser-container can be inexpensive.

The present invention defined in claim 4 is characterized in that in addition to the invention defined in claim 2 or 3, the grip has crease at the bottom portion thereof, so that the grip can be easily grasped.

Furthermore, according to the present invention defined in claim 4, the grip has no adhesive coated thereon, and in addition, it has another crease formed at the bottom portion thereof. Thus, the grip keeps its floating condition along the crease once it has been opened. Accordingly, the grip can be easily grasped in successive occasions.

The reinforcing sheet used in the present invention may be thicker than that forming the container, and the material of the reinforcing sheet may be a film made of synthetic resins such as polyethylene terephtalate (PET), polypropylene (PP), polyethylene (PE). The thickness of the reinforcing sheet is preferably more than 80 micrometer in order to prevent waving of the reinforcing sheet. However, if the thickness is excessive, the rigidity of the reinforcing sheet becomes excessive and edges may injure the user. Therefore, the thickness of the reinforcing sheet is preferably at the most 150 micrometer. It is more preferable that its thickness is between 100 and 130 micrometer.

According to the present invention defined in claim 7, the above-described objects are achieved by a process for producing resealable dispenser-containers comprising applying a pressure sensitive adhesive on one side of a long sheet, which is harder than a sheet for forming a container, except for a narrow region continuing in a longitudinal direction of the sheet or except for narrow regions spacing in a longitudinal direction of the sheet and extending in a lateral direction of the sheet, attaching a releasing sheet on the pressure sensitive adhesive applied on the one side of the hard sheet, punching the hard sheet except for the releasing sheet so as to form open looped cut lines, each of which is larger than an opening for dispensing contents or weakened line for forming the dispensing opening, and closed looped cut lines, each encircling the open looped cut line, each open looped cut line being so formed that a bulge shaped grip is formed at a front portion opposite to an open portion of the open looped cut line, the punching being so effected that the bulge shaped grip is positioned within the narrow region wherein the pressure sensitive adhesive has not been applied and that one side of the closed looped cut line near the grip is positioned in a region wherein the pressure sensitive adhesive has been applied, removing a portion on the hard sheet except for those encircled by the closed looped cut lines from the releasing sheet, and portions, encircled by the closed looped cut lines and remaining on the releasing sheet, forming reinforcing sheets, supplying the reinforcing sheets with the releasing sheet to a resealable dispenser-container manufacturing step, attaching the reinforcing sheets to the sheet for forming containers in such a manner that dispensing openings or weakened lines for forming the dispensing openings formed on the sheet for containers are positioned inside of the open looped lines, continuously wrapping and sealing the contents by the sheet to form continued containers, and cutting the sealed sheet in individual dispenser-containers.

The present invention defined in claim 8 is characterized in that in the process defined in claim 7, a crease is formed at the open portion of the open looped cut line in such a manner that it extends across the open portion, when the open looped cut line and the closed looped cut line are punched on the hard sheet.

The present invention defined in claim 9 is characterized in that in the process defined in claim 7 or 8, a crease is formed at a bottom portion of the grip, when the open looped cut line and the closed looped cut line are punched on the hard sheet.

BRIEF DESCRIPTION OF THE SEVERAL VIEWS OF THE DRAWINGS

The present invention will now be explained in detail with reference to the illustrated embodiments, wherein:

FIG. 1 shows perspective views of an embodiment of a dispenser-container of the present invention wherein;

Figure 2:
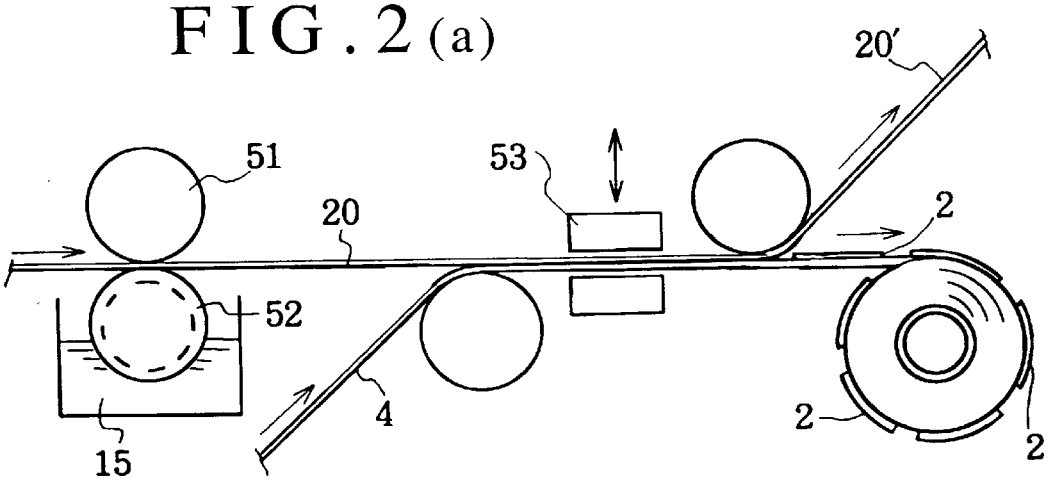
Figure 2:
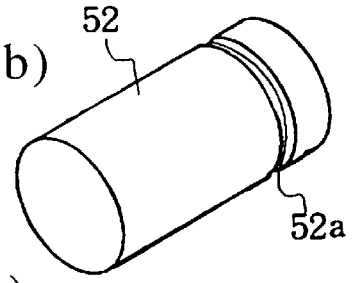
Figure 2:
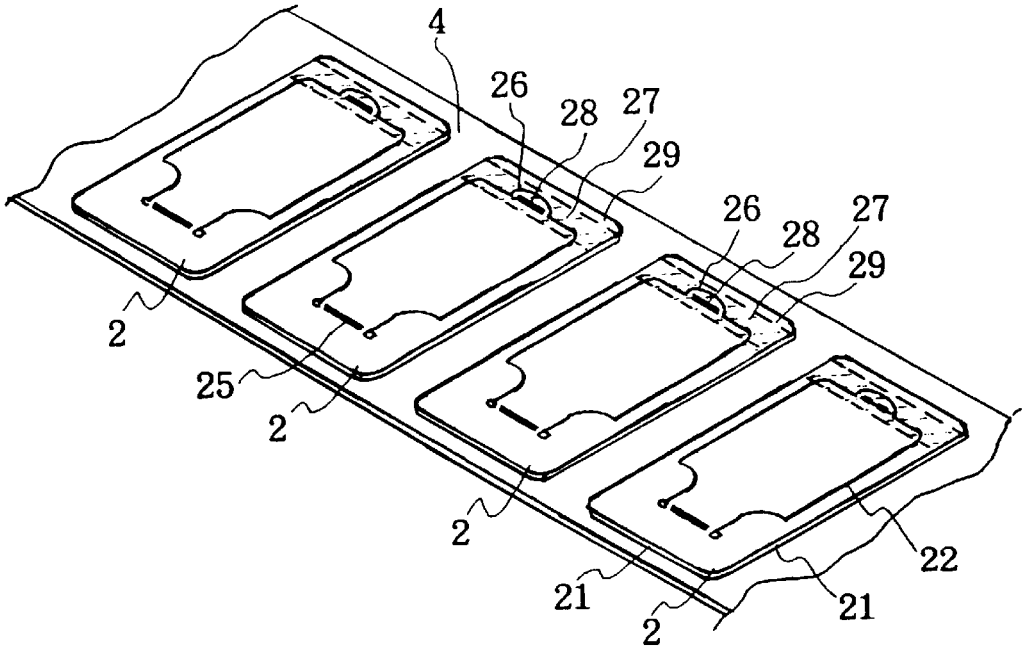
Figure 3:
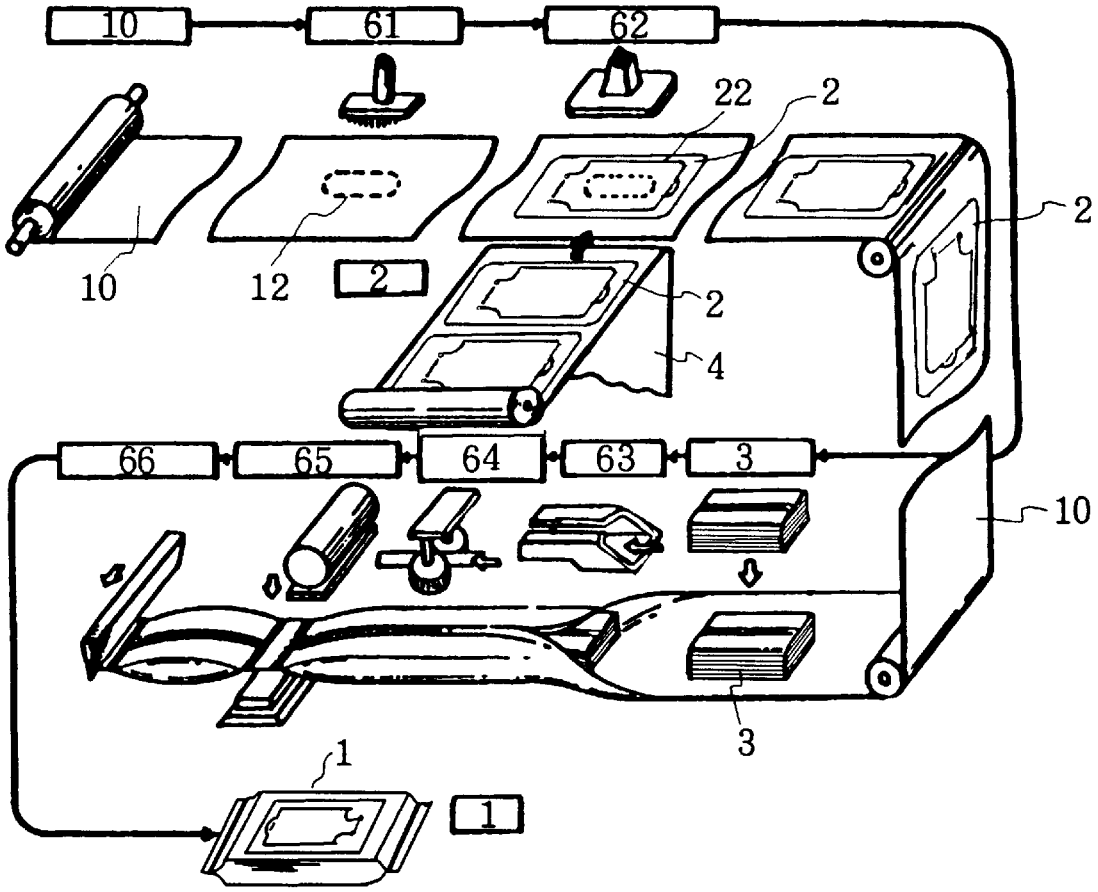
Figure 4:
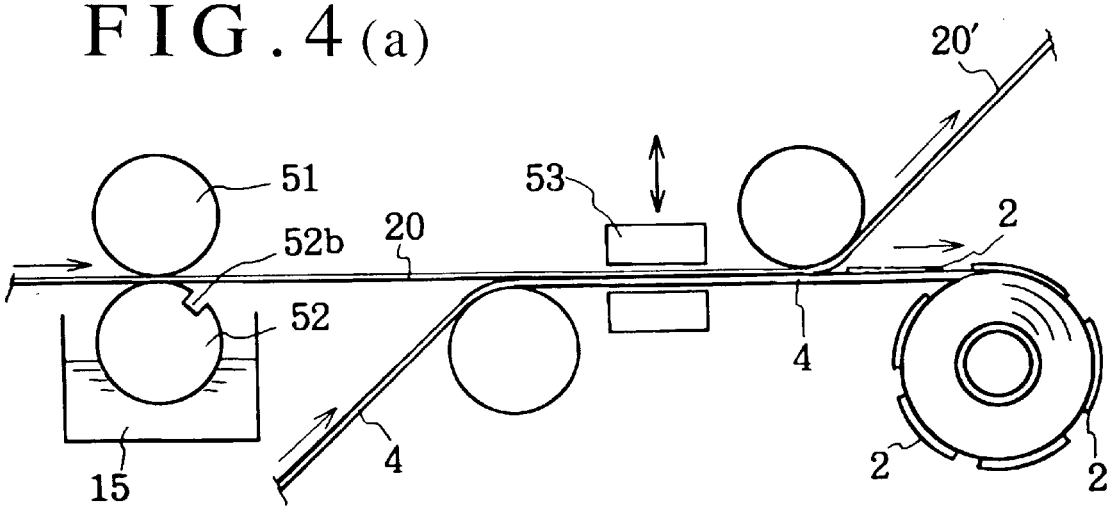
Figure 4:
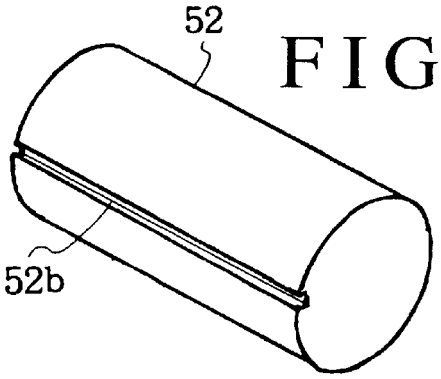
Figure 4:
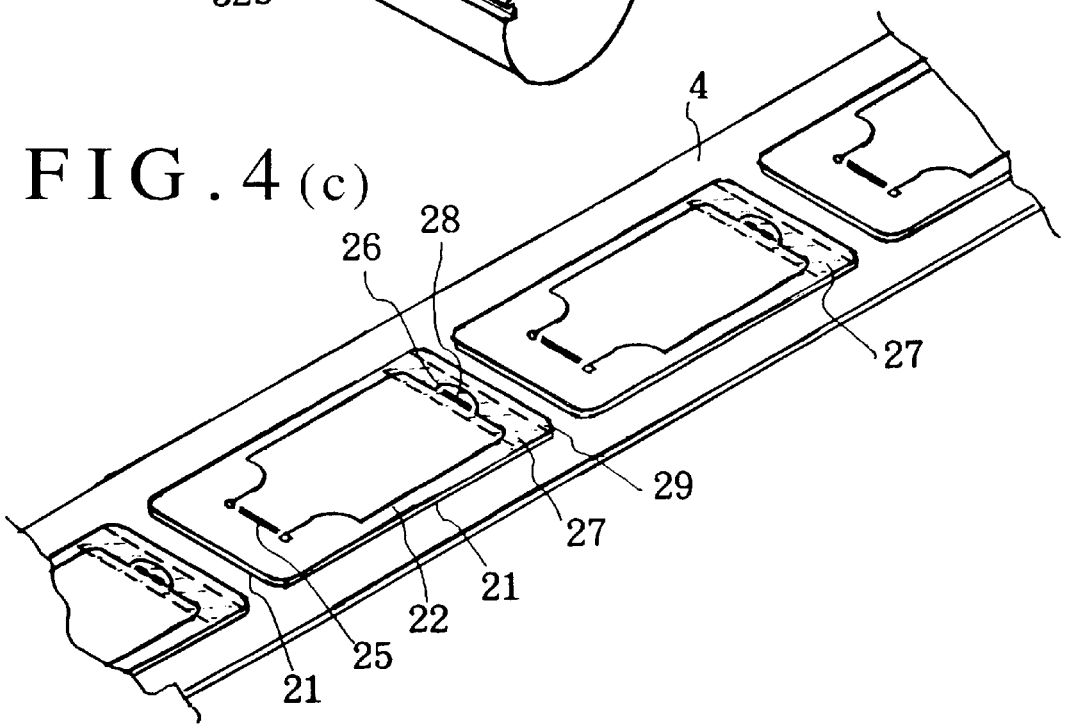

(*a*) shows a condition wherein the flap is closed, and (*b*) shows a condition wherein the flap is open;

FIG. 2 shows views explaining an embodiment of a process for manufacturing reinforcing sheets according to the present invention wherein;

(*a*) is a side view of the manufacturing process of the reinforcing sheets, (*b*) is a perspective view of a printing roller of the applying apparatus, and (*c*) is a perspective view of the reinforcing sheets supplied to the apparatus for manufacturing the dispenser-containers;

FIG. 3 is a perspective view of the process for manufacturing the dispenser-containers according to the present invention; and FIG. 4 shows views explaining another embodiment of a process for manufacturing reinforcing sheets according to the present invention wherein;

(*a*) is a side view of the manufacturing process of the reinforcing sheets, (*b*) is a perspective view of a printing roller of the applying apparatus, and (*c*) is a perspective view of the reinforcing sheets supplied to the apparatus for manufacturing the dispenser-containers.

PREFERRED EMBODIMENTS

In the following explanation of the embodiments, wet tissues are exemplified as the contents 3 contained in the dispenser-container 1. However, the contents 3 of the present invention are not limited to the wet tissues. It is preferred that the contents 3 of the present invention are not consumed at the same time, but are consumed gradually and dispensed repeatedly from the dispenser-container 1 and that they are required to be preserved long, dustproof, fungus-proof, airtight or liquid tight.

The contents 3 may be for example, cosmetics made of fibrous material such as non-woven fabric or cotton impregnated with toilet water or milky lotion; medical goods such as gauze, cotton buds, absorbent cotton or gauze impregnated with antiseptic solution or treatment medicine; tools such as screws, nuts or nails; stationery such as pins, or clips; foods such as dry cakes, wet cakes or solid seasonings.

The flexible sheet 10 constituting a container 1 may be a film made of synthetic resins such as polyethylene, polypropylene, polyester, polyamide, and polyvinyl chloride, and the film may be a single layer or a laminated layer. The film may be a laminated layer of the above-mentioned film and an aluminum foil or paper.

Figure 1:
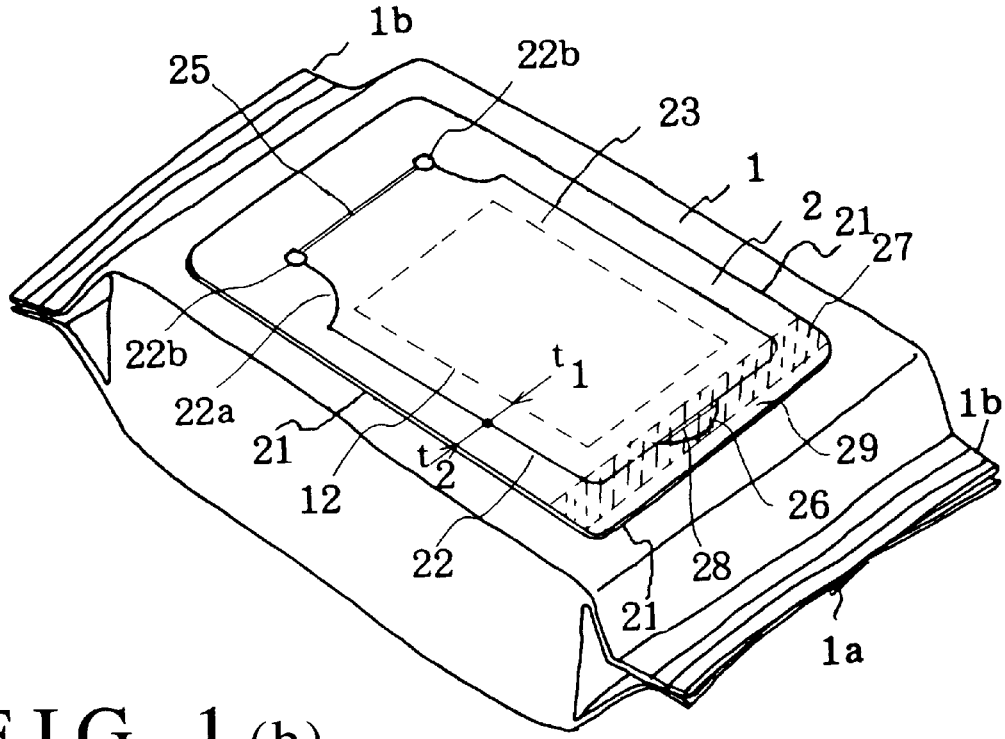
Figure 1:
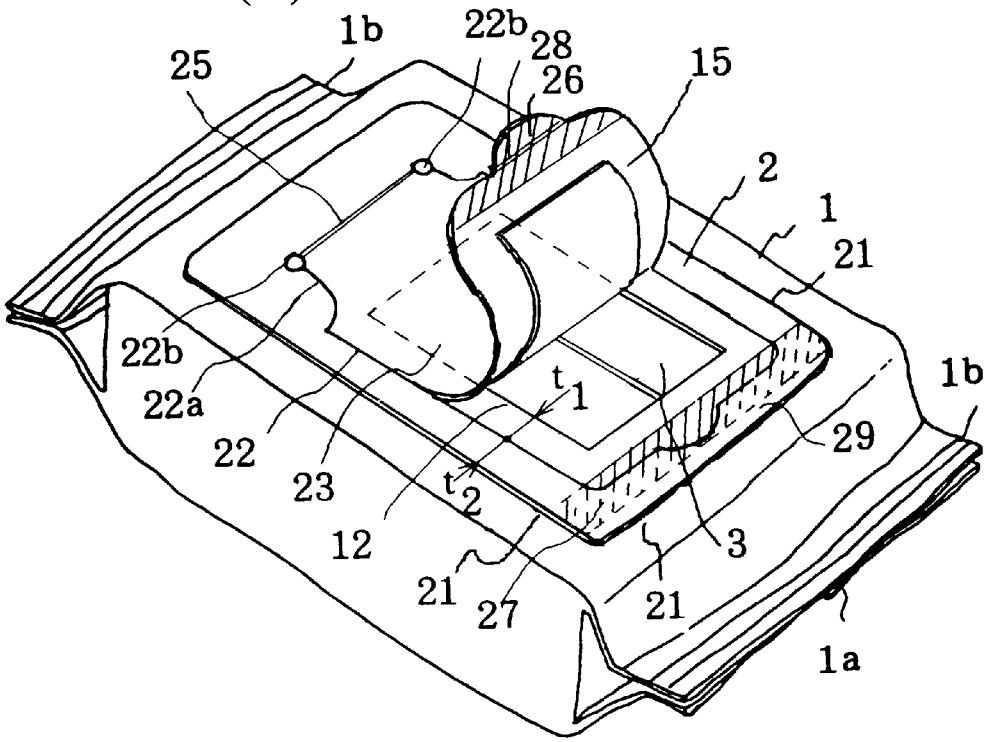

Referring to FIG. 1, the dispenser-container according to the present invention comprises a container 1 made of a flexible sheet 10 and a reinforcing sheet 2. In the illustrated embodiment, the container 1 is formed in a so called pillow type bag, i.e., a bag wherein longitudinal ends 1*a* and transversely ends 1*b* are sealed, respectively, and the container 1 contains wet tissues 3 therein as illustrated in FIG. 1(*b*).

The sheet 10 forming the container 1 may be airtight or liquid tight depending on the contents 3 contained therein. For example, for containing wet tissues, fibrous materials impregnated with toilet water or medicine, or wet cakes, it is preferred that air tight or liquid tight sheet is used. When containing dry cakes with desiccant or nails with an anticorrosive, it is preferred that an airtight sheet is used so as to prolong the effects of the contained agents.

The container 1 has an opening 12 for dispensing the wet tissues 3 therethrough and the reinforcing sheet 2 for covering the top surface including the opening 12 of the container 1 attached thereto.

The dispensing opening 12 formed in the container 1 may be formed in any suitable shape, such as an ellipse, a circle, a rectangle or a rhombus. When the dispensing opening 12 is formed by a weakened line 13, the weakened line 13 may be a perforated line when it is seen in the plan view of the container 1 or a V-shaped slit when it is seen in a cross sectional view taken along the thickness direction of the sheet forming the container 1. The weakened line is formed on the container 1 to form a closed loop or an open loop such as U-shape when it is seen in the plan view of the container 1.

As illustrated in FIG. 1, the reinforcing sheet 2 is attached to the top surface of the container so as to cover the dispensing opening 12. The reinforcing sheet 2 has an open looped cut line 22 formed therein, and the portion 23 of the reinforcing sheet 2, which portion is encircled by the open looped cut line 22, serves as a flap while the portion between the open looped cut line 22 and the outer peripheral edges 21 serves to prevent waiving of the top surface of the container 1.

As described above, in FIG. 1, the reinforcing sheet 2 is attached to the top surface of the container 1 so as to cover the above-described dispensing opening 12 and is a member other than the container 1. The material of the reinforcing sheet 2 is similar to that of the container 1 and may be a film made of synthetic resins such as polyethylene, polypropylene, polyester, polyamide, and polyvinyl chloride, and the film may be a single layer or a laminated layer. The film may be a laminated layer of the above-mentioned film and an aluminum foil or paper, i.e., synthetic paper. The reinforcing sheet 2 is required to be of a material harder, i.e., more stiff, than that of the container 1.

The thickness of the reinforcing sheet 2 is preferably between 80 and 150 micrometer, and it is more preferable that the thickness of the reinforcing sheet 2 is between 100 and 130 micrometer.

A single layered polyester sheet of between 100 and 130 micrometer is especially suitable for the reinforcing sheet 2 of the present invention. Since polyester has superior characteristic in transparency, the surface of the container 1 locating beneath the reinforcing sheet 2 can be visual. Accordingly, if a desired printing is applied on the container 1, printing on the reinforcing sheet 2 may be omitted. When this method is taken place, the cost for manufacturing dispenser-container can be lowered compared with that of the conventional method wherein the printing is done on both the container 1 and the flap.

The single layered polyester sheet of between 100 and 130 micrometer has not been able to be used for a conventional flap since it is too hard and is difficult to be adhered to a container. Contrary to this, according to the present invention, since flap is formed as a part of the reinforcing sheet 2, such a polyester sheet can be used, and further, crease 25, which is formed at the open portion of the open looped cut line 22 as will be described later, helps the usage of such polyester sheet.

The size of the reinforcing sheet 2 is larger than the dispensing opening 12 formed in the container 1, and it has an open looped cut line 22 locating outside of the dispensing opening formed in the container 1. In the illustrated embodiment, the open looped cut line 22 is formed in almost a U-shape and is formed by a Thompson knife. When a sheet is thicker than 130 micrometer, it is preferred that a heated knife is used. Thus, the cut edges 22 do not become sharp, and user are not injured by the edges 22 of the flap 23. The end of the loop, i.e., the bottom of the U-shape, in the open looped cut line 22 has a grip 26, for example in a semi circular shape in the illustrated embodiment.

The open looped cut line 22 is selected its location and size so that it locates outside the dispensing opening 12 and that it is larger than the dispensing opening 12, for example it is so selected that a distance $t_1$ of between 5 and 15 mm is formed between the dispensing opening 12 and the open looped cut line 22. Further, it is so selected that a distance $t_2$, which is, for example, of between about 5 and 15 mm, is formed between the open looped cut line 22 and the outer periphery of the reinforcing sheet 2.

Further, the open portion, which is opposite to the grip 26, of the open looped cut line 22 in the reinforcing sheet 2 is cut as cuts 22*a* toward inside from the side edges so that the width between the open portion becomes narrower than that at the central portion of the open looped cut line 22. Small holes or circular portions are formed at the ends 22*b* of the cuts 22*a* as removal stopping portions. A crease 25 is formed across the open portion, which is opposite to the grip 26, of the open looped cut line 22 near the removal stopping portions. The crease 25 may be formed by means of a press simultaneously with formation of the open looped cut line 22.

The reinforcing sheet 2 has a pressure sensitive adhesive 15, such as polyester adhesive, acrylic adhesive or rubber adhesive, applied to one side thereof, i.e., the side contacting with container 1, except for a narrow region 27, which is designated by hatching in FIG. 1, including the grip 26.

As illustrated in FIG. 1(*b*), the narrow region 27 extends between the facing peripheral edges 21 of the reinforcing sheet 2 in a direction perpendicular to the removing direction and it is space from the peripheral edge 21 neighboring the grip 26. The narrow region 27 has no adhesive applied thereon. The portion 29 in the reinforcing sheet 2, which is located outside of the narrow region 27, i.e., the portion between the peripheral edge near the grip 26 and the narrow region 27, has pressure sensitive adhesive applied thereon. Thus, the reinforcing sheet 2 is prevented from peeling off though the narrow region 27 does not have any adhesive applied thereon.

A crease 28 is formed at the bottom portion of the grip 26. The crease 28 may be formed by means of a press together with the crease 25.

The portion 23 surrounded by the open looped cut line 22 in the reinforcing sheet 2 serves as a flap. More specifically, as illustrated in FIG. 1(*b*), in order to dispense the wet tissues 3, at first the flap is opened from the grip 26. When the flap is opened from the grip 26, the grip 26 can be easily held by finger since no pressure sensitive adhesive 15 is applied to the narrow region 27. When the grip is held and pulled, the reinforcing sheet 2 is separated along the open looped cut line 22, and the portion 23 surrounded by the open looped cut line 22 forms the flap.

Since the flap 23, which is the portion surrounded by the open looped cut line 22, has a crease 25 at the bottom portion thereof, the flap 23 can be easily turned at the crease 25 and can be easily opened.

When the flap 23 is opened, the portion surrounded by the weakened line for forming the dispensing opening 12 adheres to the flap 23, and it is removed from the container 1. The trace of the removed portion 23 which has been surrounded by the weakened line forms the dispensing opening 12.

Contrary to this, since the portion between the open looped cut line 22 and the peripheral edges of the reinforcing sheet 2 always securely adheres to the top surface of the container at a portion surrounding the dispensing opening, it prevents waving of the top surface of the container when the flap 23 is opened and closed, and accordingly, the flap is closed sealably and it fully performs its role as a reinforcing sheet 2.

The flap 23, i.e., the portion surrounded by the open looped cut line 22, can be repeatedly adhered to the container 1 by means of the pressure sensitive adhesive 15 while it covers the dispensing opening 12 formed in the container 1 or the weakened line for forming the dispensing opening 12. The flap is tend to be turned-up due to the crease 28 when it is opened by holding and pulling the grip 26, and the grip 26 keeps its floating condition along the crease 28 after the flap 23 is closed. Accordingly, the grip 26 can be easily grasped in successive occasions while the flap is closed.

A process for manufacturing the dispenser-container illustrated in FIG. 1 will now be explained with reference to FIGS. 2 and 3.

A pressure sensitive adhesive 15 is applied to one side of the long sheet 20, which is harder than the sheet 10 for forming the containers, by means of an applying apparatus. The illustrated applying apparatus is a reverse roll coater, by which the adhesive 15 is applied to the sheet 20 while the sheet 20 passes through the upper and lower rollers 51 and 52. In this embodiment, the printing roller 52 has a groove 52*a* formed in a circumferential direction thereof as illustrated in FIG. 2(*b*), and the adhesive 15 is not applied to the sheet at portion corresponding to the groove 52*a* . Accordingly, the hard sheet 20 passing though the applying apparatus has adhesive 15 on almost all the surface except for a narrow region continuing in a longitudinal direction. Although the reverse roll coater is illustrated in FIG. 2, the applying apparatus is not limited to such apparatus.

Then, a releasing sheet 4 is attached to the adhesive applied surface of the hard sheet 20. Except for the releasing sheet 4, open looped cut lines 22, each of which is larger than the dispensing opening or weakened line 12 for forming the dispensing opening, and closed looped cut lines, encircling the open looped cut lines, are formed by a press apparatus provided with Thompson knives, so that the open looped cut lines 22 and the closed looped cut lines, which will later form the peripheral edges 21 of the reinforcing sheet 2, are formed.

The open looped cut line 22 has such a shape that a bulge shaped grip 26 is formed at an front end opposite to the open portion, and the punching is so performed that the bulge shaped grip 26 is positioned within the narrow region where the pressure sensitive adhesive has not been applied and that one side of the closed loop near the grip 26 is positioned within the region where the pressure sensitive adhesive has been applied. Simultaneous with the punching operation, a crease 25 and a crease 28 are formed at the open portion of the open loop and the bottom portion of the grip 26, respectively, by means of the press apparatus 53.

Then, the portions 20' other than those encircled by the closed loop 21 in the hard sheet 20 is removed from the releasing sheet 4. The portions remaining on the releasing sheet 4 and encircled by the closed loops 21 become the reinforcing sheets 2.

As illustrated in FIG. 3, the reinforcing sheets 2 are supplied to the dispenser-container manufacturing step while they are being attached to the releasing sheet 4.

Referring to FIG. 3, dispensing openings or weakened lines for forming the dispensing openings 12 are formed on a long and flexible sheet 10 for forming container by means of a press apparatus 61. The reinforcing sheets 2 are removed from the releasing sheet 4 and are attached to the dispenser-container forming sheet 10 in such a manner that the dispensing opening or the weakened line for forming the dispensing opening 12 formed on the dispenser-container forming sheet 10 is positioned within the open looped cut lines 22 formed on the reinforcing sheet 2, by means of a conventionally known label applying machine or by hand.

Using a usual bag forming machine, the contents 3 are sealably wrapped by means of the dispenser-container forming sheet 10 having reinforcing sheet 2 attached thereto, and the wrapped contents are cut into individual dispenser-containers. For example, the contents 3 are supplied from above or below onto the dispenser-container forming sheet 10, and the sheet 10 is guided by means of a guide member 63 in such a manner that it wraps the contents 3. Then, the longitudinal edges 1*a* (see FIG. 1) are fixedly sealed together by means of a heat sealer 64 so as to seal the longitudinal opening, and another heat sealer 65 seals the opening in a lateral direction so as to form the end seals. Thereafter, a cutter 66 cuts portions near the end sealed portions 1*b* (see FIG. 1) so as to form individual dispenser-container 1.

The embodiment illustrated in FIG. 4 differs from that illustrated in FIG. 2 in the following points. In this embodiment, as illustrated in FIG. 4(*b*), a printing roller 52 in the applying apparatus has a groove 52*b* parallel to the axis thereof, and the adhesive 15 is not applied to the sheet 20 at the groove 52*b* . Accordingly, narrow regions 27, wherein the adhesive has not been applied, are formed on the sheet 20 spacing in a longitudinal direction of the sheet 20. The open looped cut lines 22 and the closed looped cut lines 21 are punched so that the bulge shaped grips 26 are positioned within the narrow regions 27. As a result, as illustrated in FIG. 4(*c*), the reinforcing sheets 2 attached to the releasing sheet 4 are obtained, and they are supplied to the dispenser-container manufacturing step. Other constructions of this embodiment are the same as those of the previous embodiment illustrated and explained with reference to FIG. 2.

ADVANTAGES OF THE INVENTION

According to the present invention, the reinforcing sheet 2 attached to the container 1 prevents waving of the top surface of the container 1 and at the same time serves as a flap 23. Accordingly, the reinforcing sheet 2 can be disposed by means of a disposing process similar to that for a conventional flap. Thus, the manufacture of the dispenser-container of the present invention is easy.

According to the present invention, relatively hard reinforcing sheet 2 is attached to the top surface of the container 1, and the inside region of the open looped cut line 22 formed on the reinforcing sheet 2 is used as a flap 23. Accordingly, even when the size of the container 1 decreases as dispensing the contents, the outside region of the reinforcing sheet 2 locating outside of the open looped cut line 22 prevents waving of the top surface of the container 1. Thus, the flap 23 can be sealably secured to the container 1.

Further, according to the present invention, the reinforcing sheet 2 has a crease 25 locating at the open portion of the open looped cut line 22 and extending across the open portion. Accordingly, when a flap 23 formed in the hard reinforcing sheet 2 is opened along the open looped cut line 22, the rigidity of the open portion of the flap 23 is weakened by means of the crease 25. Thus, even when a thick sheet is used for the reinforcing sheet 2, the flap 23 can be easily kept in an opened condition, and the contents such as wet tissues contained in the container 1 can be dispensed without any trouble. Further, after the contents are dispensed, since the rigidity of the flap is weakened by the crease 25, the flap 23 can be readily closed.

Furthermore, according to the present invention, the grip 26 has no adhesive 15 coated thereon, and in addition, it has another crease 28 formed at the bottom portion thereof. Thus, the grip 26 keeps its floating condition along the crease 28 once it has been opened. Accordingly, the grip 26 can be easily grasped in successive occasions.

According to the present invention defined in claim 2, the narrow region, wherein the grip is formed, does not have any adhesive, and accordingly, the grip has no adhesive applied thereon. Thus, the grip can be readily grasped. In addition, since the edge portion between the narrow region and the peripheral edge neighboring the grip has adhesive applied thereon, the edge portion securely adheres to the surface of the container. Accordingly, the reinforcing sheet does not peel off regardless of existence of the narrow region.

Further, according to the present invention defined in claim 2, the narrow region having no adhesive applied thereon extends between the facing peripheral edges. Accordingly, the reinforcing sheet of the present invention can be manufactured by applying a pressure sensitive adhesive on one side of a long sheet except for a narrow region continuing in a longitudinal direction of the sheet or except for narrow regions spacing in a longitudinal direction of the sheet and extending in a lateral direction of the sheet and punching the sheet in such manner that the grip positions within the narrow region, when the reinforcing sheet is manufactured from a long sheet. Upon such punching, since positioning in one direction, i.e., either longitudinal direction or lateral direction, is only required, positioning can be easily and accurately done even if the preciseness of the punching apparatus is not excessively enhanced. Thus, continuous manufacture of dispenser-containers can be done effectively, and as a result, cost of the dispenser-container can be inexpensive.

According to the process of the present invention, by selecting a special applying method of the pressure sensitive adhesive to the hard sheet which forms the reinforcing sheet, the narrow regions wherein no adhesive is applied thereto are formed, and at the same time, by selecting a special locational relationship between the narrow regions and the open and closed looped cut lines, the dispenser-containers provided with the reinforcing sheet can be manufactured by means of the dispenser-container manufacturing process, wherein the number of steps is almost the same as that for a conventional dispenser-container provided with no reinforcing sheet, and the number of parts in the dispenser-container is not increased. Since the conventional apparatus which has been used for manufacturing conventional dispenser-containers can be used for the process of the present invention, it is very economical. Further, since the process for manufacturing the reinforcing sheets according to the present invention is almost the same as that for manufacturing conventional flaps, the reinforcing sheets can be effectively manufactured by apparatus which is similar to a conventional one.

Further, according to the process of the present invention, when the open and closed looped cut lines are punched on the hard sheet, the crease extending in the lateral direction of the open portion of the open looped cut line and the crease at the bottom portion of the grip can be formed together with punching. Thus, the dispenser-containers of the present invention can be manufactured without substantially increasing the number of the steps.

What is claimed is:

1. A resealable dispenser-container for containing contents therein comprising a container, which is made of a flexible and impervious sheet and which has at a top surface thereof an opening for dispensing the contents therethrough or a weakened line for forming the dispensing opening, a flap made of a flexible sheet material which covers the dispensing opening or weakened line for forming the dispensing opening and which is repeatedly opened and closed, a reinforcing sheet, which is larger than the dispensing opening or weakened line for forming the dispensing opening, and which is made of a material harder than that forming the container, attached to the top surface of the container, the reinforcing sheet having an open looped cut line locating outside of the dispensing opening or weakened line for forming the dispensing opening, an inside region of the open looped cut line being removable from a front end which is opposite to an open portion of the open looped cut line toward the open portion so as to form the repeatedly opened and closed flap, and the reinforcing sheet having a crease locating at the open portion of the open looped cut line and extending across the open portion so as to facilitate opening and closing of the repeatedly opened and closed flap formed by the inside region of the open looped cut line.

2. A resealable dispenser-container for containing contents therein comprising a container, which is made of a flexible and impervious sheet and which has at a top surface thereof an opening for dispensing the contents therethrough or a weakened line for forming the dispensing opening, a flap made of a flexible sheet material which covers the dispensing opening or weakened line for forming the dispensing opening and which is repeatedly opened and closed, a reinforcing sheet, which is larger than the dispensing opening or weakened line for forming the dispensing opening, and which is made of a material harder than that forming the container, attached to the top surface of the container, the reinforcing sheet having an open looped cut line locating outside of the dispensing opening or weakened line for forming the dispensing opening and inside spacing from a peripheral edge of the reinforcing sheet, an inside region of the open looped cut line being removable from a front end which is opposite to an open portion of the open looped cut line toward the open portion so as to form the repeatedly opened and closed flap, and a bulge shaped grip formed at the front end opposite to the open portion of the open looped cut line, the reinforcing sheet having a narrow region including the grip and extending between facing peripheral edges of the reinforcing sheet in a direction perpendicular to a removing direction of said inside region, the narrow region spacing from a peripheral edge neighboring the grip, and the reinforcing sheet having a pressure sensitive adhesive applied to one side thereof except for the narrow region.

3. A resealable dispenser-container for containing contents therein comprising a container, which is made of a flexible and impervious sheet and which has at a top surface thereof an opening for dispensing the contents therethrough or a weakened line for forming the dispensing opening, a flap made of a flexible sheet material which covers the dispensing opening or weakened line for forming the dispensing opening and which is repeatedly opened and closed, a reinforcing sheet, which is larger than the dispensing opening or weakened line for forming the dispensing opening, and which is made of a material harder than that forming the container, attached to the top surface of the container, the reinforcing sheet having an open looped cut line locating outside of the dispensing opening or weakened line for forming the dispensing opening and inside spacing from a peripheral edge of the reinforcing sheet, the inside region of the open looped cut line being removable from a front end which is opposite to an open portion of the open looped cut line toward the open portion so as to form the repeatedly opened and closed flap, and a bulge shaped grip formed at the front end opposite to the open portion of the open looped cut line, the reinforcing sheet having a narrow region including the grip and extending between facing peripheral edges of the reinforcing sheet in a direction perpendicular to a removing direction of said inside region, the narrow region spacing from a peripheral edge neighboring the grip, and the reinforcing sheet having a pressure sensitive adhesive applied to one side thereof except for the narrow region, the reinforcing sheet having a crease locating at the open portion of the open looped cut line and extending across the open portion so as to facilitate opening and closing of the repeatedly opened and closed flap formed by the inside region of the open looped cut line.

4. A resealable dispenser-container according to claim 2 or 3, the bulged shaped grip has another crease formed at the bottom portion thereof so as to facilitate grasping of the grip.

5. A resealable dispenser-container according to claim 1, 2 or 3, wherein the thickness of the reinforcing sheet is between 80 and 150 micrometer.

6. A resealable dispenser-container according to claim 1, 2 or 3 wherein the thickness of the reinforcing sheet is between 100 and 130 micrometer.

7. A process for producing resealable dispenser-containers comprising applying a pressure sensitive adhesive on one side of a long sheet, which is harder than a sheet for forming a container, except for a narrow region continuing in a longitudinal direction of the sheet or except for narrow regions spacing in a longitudinal direction of the sheet and extending in a lateral direction of the sheet, attaching a releasing sheet on the pressure sensitive adhesive applied on the one side of the hard sheet, punching the hard sheet except for the releasing sheet so as to form open looped cut lines, each of which is larger than an opening for dispensing contents or weakened line for forming the dispensing opening, and closed looped cut lines, each encircling the open looped cut line, each open looped cut line being so formed that a bulge shaped grip is formed at a front portion opposite to an open portion of the open looped cut line, the punching being so effected that the bulge shaped grip is positioned within the narrow region wherein the pressure sensitive adhesive has not been applied and that one side of the closed looped cut line near the grip is positioned in a region wherein the pressure sensitive adhesive has been applied, removing a portion on the hard sheet except for those encircled by the closed looped cut lines from the releasing sheet, and portions, encircled by the closed looped cut lines and remaining on the releasing sheet, forming reinforcing sheets, supplying the reinforcing sheets with the releasing sheet to a resealable dispenser-container manufacturing step, attaching the reinforcing sheets to the sheet for forming containers in such a manner that dispensing openings or weakened lines for forming the dispensing openings formed on the sheet for containers are positioned inside of the open looped lines, continuously wrapping and sealing the contents by the sheet for forming continued containers, and cutting the sealed sheet in individual dispenser-containers.

8. A process according to claim 7, wherein a crease is formed at the open portion of the open looped cut line in such a manner that it extends across the open portion, when the open looped cut line and the closed looped cut line are punched on the hard sheet.

9. A process according to claim 7 or 8, wherein a crease is formed at a bottom portion of the grip, when the open looped cut line and the closed looped cut line are punched on the hard sheet.

* * * * *

UNITED STATES PATENT AND TRADEMARK OFFICE
CERTIFICATE OF CORRECTION

PATENT NO. : 6,026,953

DATED : February 22, 2000

INVENTOR(S) : Kenji NAKAMURA et al.

It is certified that error appears in the above-identified patent and that said Letters Patent is hereby corrected as shown below:

Column 1, line 11, change "in several" to --at different--;
line 20, change "Containers used for such use" to --These containers--;
line 22, change "be ensured to easily dispense" to --ensure easy dispensing of--;
line 28, delete "of"; line 44, change "tried to be attached" to --reattached--;
line 45, delete "again".

Column 2, line 15, delete "dispensing" and after "contents" insert --are dispensed--.

Column 3, line 44, change "dispensing the contents" to --the contents are dispensed--;
line 49, change "locating" to --located--;
line 58, change "Further." to --Further,--.

Column 4, line 24, change "crease" to --a crease--.

Column 7, line 15, change "locating" to --located--;
line 18, change "taken place" to --used--;
line 26, change "flap" to --the flap--; line 33, change "locating" to --located--;
line 39, change "user are" to --a user is--;
line 44, after "The" and before "open" insert --location and size of the-- and change "is" to --are--;
line 44-45, delete "its location and size";
line 45, change "it" to --the open looped cut line 22-- and change "locates" to --is located--;
line 46, delete "that it"; line 55, change "inside" to --the inside--.

UNITED STATES PATENT AND TRADEMARK OFFICE
CERTIFICATE OF CORRECTION

PATENT NO. : 6,026,953

DATED : February 22, 2000

INVENTOR(S) : Kenji NAKAMURA et al.

It is certified that error appears in the above-identified patent and that said Letters Patent is hereby corrected as shown below:

Column 8, line 23, change "finger" to --the user's fingers--;
line 44, change "flap" to --flap 23--;
line 45, change "closed sealably" to --sealably closed--;
line 52, change "flap" to --flap 23--, and change "tend" to --ready--.

Column 9, line 19, change "an" to --a--.

Column 10, line 28, change "locating" to --located--.

Signed and Sealed this

Twenty-seventh Day of March, 2001

Nicholas P. Godici

*Attest:*

NICHOLAS P. GODICI

*Acting Director of the United States Patent and Trademark Office*

*Attesting Officer*